US005348451A

United States Patent [19]

Mohn

[11] Patent Number: 5,348,451

[45] Date of Patent: Sep. 20, 1994

[54] PUMP APPARATUS

[75] Inventor: Frank Mohn, London, Great Britain

[73] Assignee: Framo Developments (UK) Limited, London, United Kingdom

[21] Appl. No.: 847,038

[22] PCT Filed: Oct. 15, 1990

[86] PCT No.: PCT/GB90/01592

§ 371 Date: May 15, 1992

§ 102(e) Date: May 15, 1992

[87] PCT Pub. No.: WO91/05954

PCT Pub. Date: May 2, 1991

[30] Foreign Application Priority Data

Oct. 16, 1989 [GB] United Kingdom ..... 8923280.5

[51] Int. Cl.[5] ..... F04B 9/08

[52] U.S. Cl. ..... 417/390; 417/403; 417/383

[58] Field of Search ..... 417/390, 379, 383, 403, 417/404

[56] References Cited

U.S. PATENT DOCUMENTS

| | | | |
|---|---|---|---|
| 2,162,748 | 6/1939 | Richards | 417/383 |
| 2,277,306 | 3/1942 | Coffey | 417/383 |
| 2,490,118 | 12/1949 | Dickinson | 417/383 |
| 3,700,360 | 12/1972 | Shaddock | 417/390 |
| 3,999,896 | 12/1976 | Sebastiani | 417/383 |
| 4,223,706 | 9/1980 | McGahey | 417/404 |
| 4,431,384 | 2/1984 | Walser | 417/360 |
| 4,515,516 | 5/1985 | Perrine | 417/390 |
| 4,880,363 | 11/1989 | Holland | 417/390 |
| 5,106,274 | 4/1992 | Holtzaddle | 417/383 |

FOREIGN PATENT DOCUMENTS

| | | |
|---|---|---|
| 0332378 | 9/1989 | European Pat. Off. . |
| 3430502 | 2/1986 | Fed. Rep. of Germany . |
| 1360790 | 4/1964 | France . |
| 8808083 | 10/1988 | PCT Int'l Appl. . |
| 243664 | 1/1947 | Switzerland . |
| 601616 | 6/1978 | United Kingdom . |

*Primary Examiner*—Richard A. Bertsch
*Assistant Examiner*—Peter Korynyk
*Attorney, Agent, or Firm*—Young & Thompson

[57] ABSTRACT

A pumping apparatus has a linear electric motor (10; 40) reciprocally driving motor pistons (16; 45) hydraulically coupled with pump pistons (25) or with coupling pistons (51) mechanically connected with pump pistons (61) which move the fluid to be pumped. For undersea use, the coupling arrangements allow convenient separation and retrieval of subassemblies requiring relatively frequent servicing.

21 Claims, 2 Drawing Sheets

PUMP APPARATUS

FIELD OF THE INVENTION

The invention relates to a pump apparatus for pumping fluids.

The invention is and particularly but not exclusively related to a pump apparatus for pumping fluids which tend to wear or otherwise damage the pump elements with which they come in contact.

BACKGROUND OF THE INVENTION

A pump apparatus comprising a pump piston reciprocably driven within a cylinder to effect pumping of crude oil experiences considerable wear, particularly at the seal between the piston and the cylinder wall, and in the check valves which control the flow of the crude oil into and out of the pump chamber, because of sand and other particulate material carried along with the oil. Even where the pump apparatus is part of an undersea installation, it is not usually difficult to effect replacement of the check valves when needed, but replacement of the piston seal and/or the piston itself present more serious difficulty and may require disassembly of the apparatus.

OBJECT OF THE INVENTION

The present invention is consequently concerned with the provision of pump apparatus of a configuration to facilitate replacement of parts subjected to wear or damage and to provide protection for the driving motor by means of a barrier fluid.

SUMMARY OF THE INVENTION

The invention accordingly provides a pump apparatus in which a pump assembly acting on the fluid to be pumped is indirectly coupled to a means for driving the assembly. The invention can thus provide a pump apparatus comprising an electric drive motor, a pump assembly in which a pump piston is guided for reciprocating movement within a cylinder providing a pump chamber receiving the fluid to be pumped, and coupling means operative between the drive motor and the piston by which the motor is coupled to the piston. The indirect coupling of the motor to the pump assembly can be arranged to facilitate servicing of the latter independently of the motor, which can normally be expected to have a much longer useful lifespan and which can be all the more readily protected against a hostile environment.

Preferably, the coupling means comprises hydraulic coupling means, the electric motor being arranged to reciprocate one or more primary or drive or motor pistons, which can be single or double acting, so as to move a hydraulic fluid which acts in turn on secondary or pump pistons which contact the fluid to be pumped. The pump piston cannot then form part of a double-acting piston pump because one side is exposed to the coupling fluid moved by the motor piston. Instead therefore the motor piston can be coupled to a coupling piston which is mechanically connected to an operating piston in an operating cylinder. Both sides of the coupling piston can then be acted upon by the coupling fluid and both sides of the operating piston can act upon the fluid to be pumped.

The invention thus also provides a pump apparatus for pumping a fluid, comprising first or drive piston means having a direct mechanical connection with a drive motor, the first piston mean being hydraulically coupled to second or pump piston means engaging the fluid to be pumped. The drive and pump pistons can move in respective cylinders of different diameter, so as to move through strokes of different lengths.

The pump apparatus of the invention preferably includes means for selectively shutting off the space between the primary and secondary piston means for example a connecting device and/or selectively operable valve sealing means, to allow the separation of the motor drive arrangements from the secondary pumping cylinders, when the latter are being serviced or replaced. The servicing of subsea pumping apparatus can thus be greatly facilitated by the present invention.

The drive motor is conveniently a linear electric motor, of which the driven element can be connected at its ends to respective pistons movable in aligned cylinders containing the hydraulic coupling fluid and communicating this fluid to secondary cylinders containing the pump pistons.

The electric motor is conveniently received within a closed motor housing containing a protective barrier fluid. The housing can communicate into the primary cylinders in which the primary pistons separate the barrier fluid from the coupling fluid. The protective and hydraulic coupling fluid can be the same, but different fluid can be employed for the latter, for example, one that it is desired to inject into the crude oil or other fluid to be pumped, by way of leakage through the seals of the secondary pistons.

The differential pressures within the pumping apparatus of the invention will tend to limit entry of the pumped fluid into the motor housing, and to protect the electric motor from excess pressures in the event of a failure of the secondary piston seal at a time when there is high pressure in the discharge line.

The hydraulic coupling fluid can provide a "cofferdam"-like protection for the pump, with a circulating protective fluid, although it is then necessary to provide two fluid lines to the surface where the pump is located at a subsea installation, together with double skin or seal arrangements at all connections. The moving parts of the pump, in particular, the electric motor, are thus very effectively protected.

BRIEF DESCRIPTION OF THE DRAWINGS

The invention is further described below, by way of example, with reference to the accompanying drawings, in which.

DETAILED DESCRIPTION OF THE PREFERRED EMBODIMENTS

Figure 1:
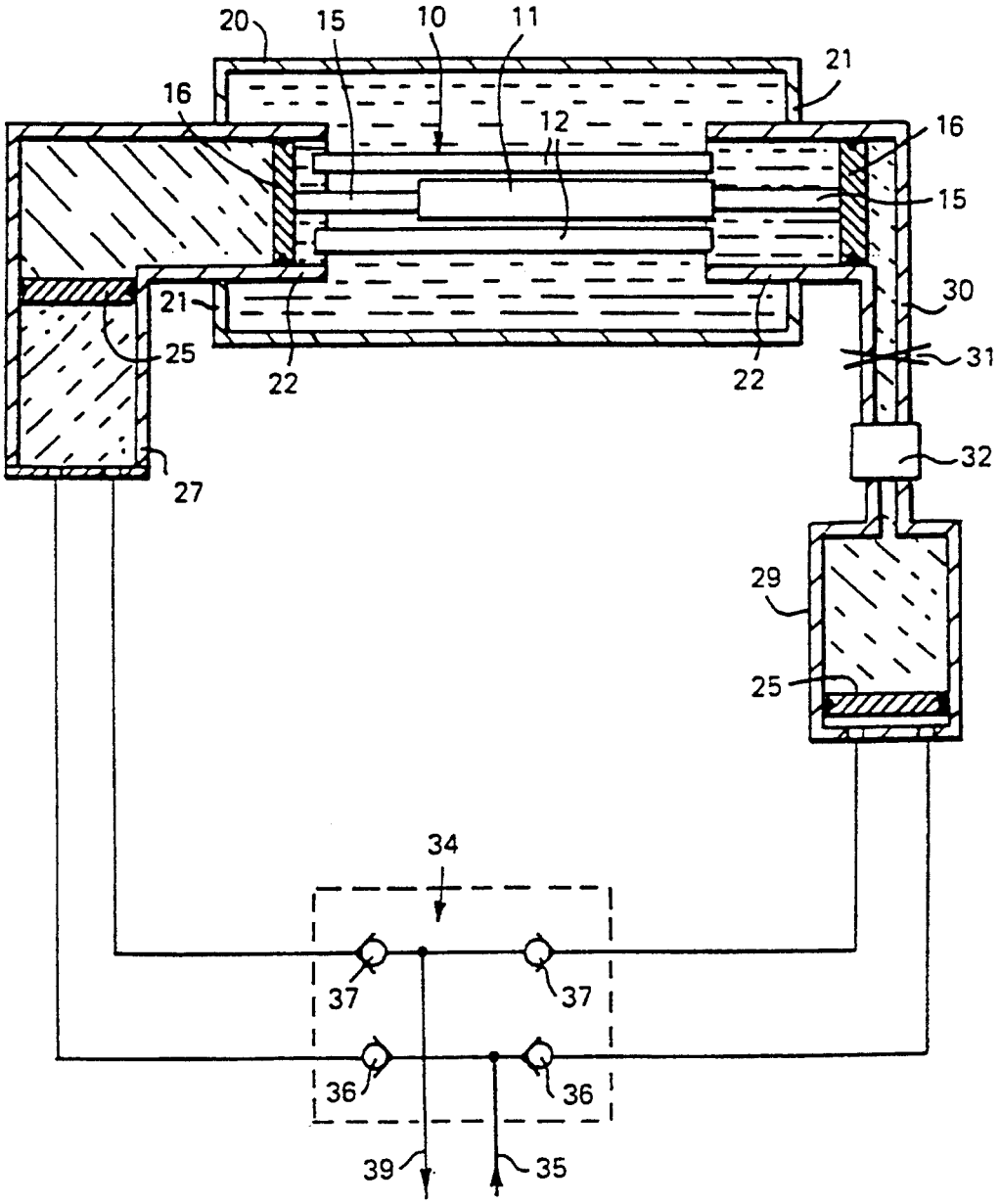
FIG. 1 is a schematic sectional side view of a first pump apparatus embodying the invention.

The pumping apparatus of FIG. 1 is intended for use in a subsea installation, for pumping crude oil from an undersea well. The apparatus has as its drive motor a linear electric motor 10 comprising a driven element 11 in the form of a flat plate received between a pair of energisable stator or drive elements 12 of generally similar form. The motor configuration shown in the figure is illustrative only; details of suitable linear motor configurations and control arrangements for them may be had from EP 0 332 378, which is incorporated herein by reference.

Extending from the ends of the driven element 11 along its direction of movement are piston rods 15 each carrying at its free end a primary or drive piston 16. The motor 10 is received within a motor housing 20 having opposed end walls 21, through each of which extends a pump cylinder 22 in which a respective one of the pistons 16 is slidably received in pump spaces on opposite sides of piston 16. The piston rods 15, the pistons 16 and the cylinders 22 are aligned on a common axis corresponding to the direction of movement of the driven element 11. The piston assembly comprising the motor element 11, the pistons 16 and piston rods 15, is guided for reciprocating movement along this axis, and means is provided to energize the stator elements 12 so as to produce such movement when operation of the pump apparatus is required.

The interior of the motor housing 20 communicates with the inner ends of the cylinders 22 protruding into it and contains an electrically insulating barrier liquid which is moved within the housing and the cylinder ends on operation of the motor 10.

The crude oil or other fluid to be pumped by the apparatus does not come into contact with the pistons 16, but is moved instead by secondary or drive pistons 25 each of which is driven hydraulically by a respective one of the pistons 16. As shown at the left hand side of FIG. 1, each piston 25 can be guided for reciprocating movement within a drive space in a drive cylinder 27 formed as an integral cylinder unit with the adjacent cylinder 22. The pistons 25 divide the interiors of the cylinders 27 into drive spaces of variable volume, of which one communicates directly with the outer ends of the cylinders 22. The space within the cylinders 22 and 27 and 29 and between the pistons 16 and 25 contains a hydraulic coupling fluid which may but need not be the same as the fluid within the housing 20. The pistons 16 and 25 are consequently coupled together and movement of the piston 16 by the motor 10 necessarily causes movement of the pistons 25, functioning as "slave" pistons.

The right-hand side of FIG. 1 shows an alternative configuration for the cylinders 22 and 29 which offers some advantages over the arrangement shown at the left-hand side. The communication between the cylinders 22 and 29 is effected by ducting 30 incorporating a shut-off valve 31 and a releasable connecting device 32. The cylinder 29 can be separated from the associated cylinder 22 after closure of the valve 31 by means of the connecting device 31 to facilitate replacement for example of the sealing arrangements of the piston 25 or of the cylinder as a whole.

The flow of crude oil into and out of the pump chambers of the cylinders 27 or 29 is controlled by a check valve assembly 34 which is conveniently also arranged so as to be readily separable from the rest of the apparatus for replacement or repair. A common supply line 35 for the crude oil leads through check valves 36 and the oil is discharged through check valves 37 to a common discharge line 39.

Figure 2:
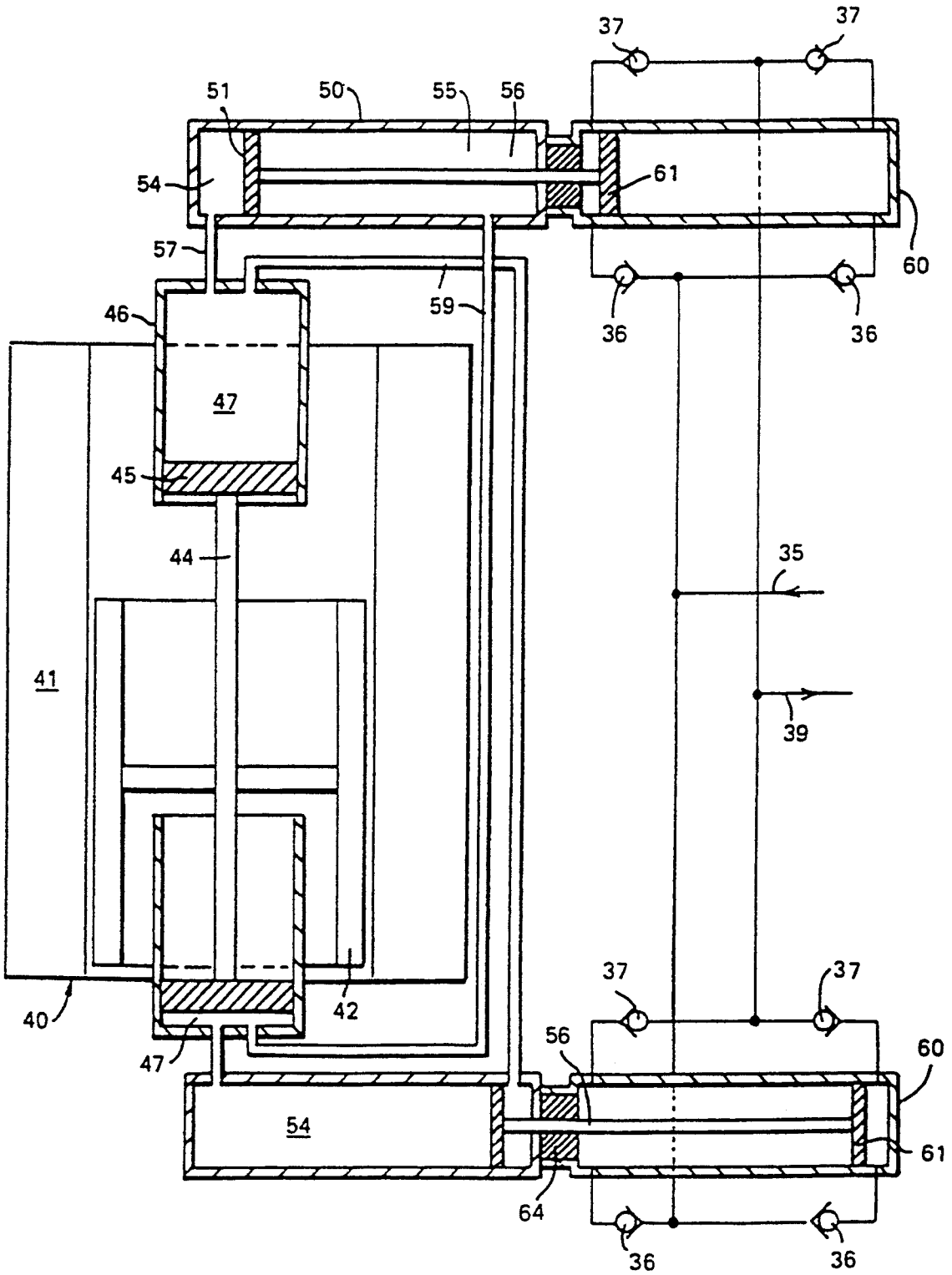
FIG. 2 is a like view of a second pump apparatus embodying the invention.

In FIG. 2 the same reference numerals as in FIG. 1 are used for certain parts which are similar or equivalent to parts of the apparatus of FIG. 1.

The second form of pump apparatus embodying the invention illustrated in FIG. 2 is again driven by a linear electric motor 40 which is again preferably of a kind disclosed in EP 0 332 378. As shown, the motor 40 can comprise a stator element 41 of cylindrical form which concentrically surrounds a driven element 42 of similar form but of shorter axial length, so that its stroke is contained within the axial length of the stator element. A piston rod 44 is secured at its axial centre point to the axial centre point of the driven element 42 and extends along the common axis of the stator and driven elements. The piston rod 44 carries a primary or motor piston 45 at each end and each piston is slidingly received within a respective motor cylinder to define a variable volume working chamber 47. The cylinders 46 are partially received within the stator element 41 and have their inner ends open.

The intermediate cylinders 50 are mounted at positions spaced from the ends of the stator element 41 so as to extend at right angles to the common axis of the linear electric motor 40 and the piston rod 44. An intermediate or coupling piston 51 slides within each intermediate cylinder and divides its interior into first and second variable volume chambers 54 and 55 of which the second contains a piston rod 56 extending outwardly of the cylinder through an aperture in its end wall. Piping 57 connects the first chamber 54 of each intermediate cylinder with the working chamber 47 of the adjacent motor cylinder 46 and piping 59 connects the second chamber 55 with the working chamber of the remote motor cylinder.

As will be evident, energisation of the stator element 41 to effect reciprocation of the driven element 42, and thus of the piston assembly comprising the piston rod 44 and the two motor pistons 45 causes a hydraulic fluid contained in the working chambers 47 and in the first chambers 54 of the intermediate cylinders to reciprocably move the slave or coupling pistons 51. From the position shown in FIG. 2, the upper piston 45 forces the hydraulic fluid into the first chamber 54 of the uppermost intermediate cylinder and into the second chamber 55 of the lower intermediate cylinder. Correspondingly, upward movement of the lower piston 45 draws fluid from the second chamber of the upper intermediate cylinder and from the first chamber of the lower intermediate cylinder. The pistons 51 are thus hydraulically coupled with the motor pistons 45 so as to move in unison with them.

The fluid to be pumped is acted upon in two operating cylinders 60 each axially aligned with and adjacent to a respective one of the intermediate cylinders 50. The piston rods 56 extend from the intermediate cylinders to respective operating pistons 61 within the operating cylinders 60 to each end of which the fluid to be pumped is supplied through supply and return lines 35 and 39 and check valves 36 and 37. In the pump apparatus of FIG. 2, each of the operating cylinders 60 is part of a double-acting piston pump, a possibility not available in the pump apparatus of FIG. 1 because the pistons 25 there function both as coupling and operating pistons.

The pumping apparatus of FIG. 2 can be provided with valves and separable connecting means, functioning similarly to the valve 31 and the connecting device 32 of the apparatus of FIG. 1, to permit separation, and separate retrieval in an apparatus used undersea, of the various sub-assemblies of which the apparatus is constituted. Although the linear electric motor 40 is spaced from pumped fluid, it can be received in a housing containing a hydraulic barrier fluid if desired, the fluid being circulated through the housing or under static pressure.

The "clean" hydraulic fluid in the chambers 47, 54 & 55 is separated from the pumped fluid in the cylinders 60 by sealing means 64 for the piston rods 56. Any fluid leakage within the cylinders 60 merely effects the volumetric efficiency of the pump apparatus.

In any embodiment of the invention, the area and stroke of the pistons can be chosen according to functional requirements and to obtain most effective utilization of the drive motor. The pistons can advantageously incorporate the sealing arrangements described in EP 0 314 493 (FD 14). The orientation of the various cylinders appearing from the drawings can be selected to suit particular applications.

As will be evident, the invention can be embodied in a variety of ways other than as specifically described.

I claim:

1. A pump apparatus comprising:

a pump piston reciprocably movable within a pump cylinder to increase and decrease a first drive space within the pump cylinder and to decrease and increase a pump space within the pump cylinder, check valve means controlling the inflow into the pump space and discharge therefrom of a fluid to be pumped, a drive piston reciprocably movable within a drive cylinder to increase and decrease the volume of a second drive space within the drive cylinder, motor means reciprocably driving the drive piston, a duct communication the first and second drive spaces, an hydraulic fluid filling said first and second drive spaces and said duct, and means in said duct permitting selective hydraulic separation of said drive and pump cylinders.

2. The pump apparatus of claim 1 wherein said duct comprises first and second portions communicating with the first and second drive spaces respectively and wherein said means in said duct comprises a releasable connection device for disconnection of said first and second duct portions.

3. The pump apparatus of claim 2 wherein said means in said duct further comprises a shut-off valve in said second duct portion.

4. The pump apparatus of claim 1 wherein said means in said duct comprises a shut-off valve.

5. The pump apparatus of claim 1 wherein said motor means comprises a linear electric motor.

6. The pump apparatus of claim 5 further comprising a housing in which said linear electric motor is received, and a protective fluid in said motor housing, said protective fluid being moved by said drive piston.

7. The pump apparatus of claim 6 wherein said drive cylinder communicates with said motor housing at the side of said drive piston remote from said drive space.

8. The pump apparatus of claim 1 wherein said check valve means is readily separable from said apparatus for replacement or repair.

9. A pump apparatus comprising:

a pump piston reciprocably movable in a pump cylinder for introduction into said pump cylinder and discharge therefrom of a fluid to be pumped, a motor piston reciprocably movable in a motor cylinder for introduction into said motor cylinder and discharge therefrom of an hydraulic coupling fluid, drive means operable to effect said reciprocable movement of said motor piston, coupling means drivingly coupling said motor piston with said pump piston, said coupling means including a duct and hydraulic fluid movable in said duct, and means in said duct for selective interruption of said hydraulic fluid movement.

10. The pump apparatus of claim 9 wherein said means in said duct comprises at least one of a shut-off valve and a releasable connecting device.

11. The pump apparatus of claim 10 having both said shut-off valve and said releasable connecting device, and wherein said releasable connecting device is located between said shut-off valve and said pump piston.

12. The pump apparatus of claim 9 wherein said coupling means further comprises a coupling piston reciprocably movable in a coupling cylinder and means mechanically connecting said coupling piston to said pump piston, said hydraulic fluid hydraulically coupling together said motor piston and said coupling piston.

13. The pump apparatus of claim 12 wherein said coupling cylinder and said pump cylinder are axially aligned and wherein said mechanical connecting means comprise a piston rod.

14. The pump apparatus of claim 9 wherein said drive means comprises a linear electric motor, and further comprising a housing within which said linear electric motor is received, and protective fluid within said housing, said motor piston acting on said protective fluid.

15. A pump apparatus comprising:

a linear electric motor having a reciprocable drive member, first and second drive pistons mounted at opposed ends of said drive member for reciprocation therewith within respective first and second drive cylinders, first and second pump pistons reciprocably movable within first and second pump cylinders respectively, coupling means containing hydraulic fluid drivingly connecting said first and second drive pistons with said first and second pump pistons respectively, said coupling means including piping communicating between said first drive and pump cylinders and between said second drive and pump cylinders, and means in said piping permitting interruption of said communication between at least one of said first drive and pump cylinders and said second drive and pump cylinders.

16. The pump apparatus of claim 15 further comprising a casing containing said linear electric motor, protective fluid within said casing, and means communicating said first and second drive cylinders with said casing wherein said drive pistons act on said protective fluid.

17. A pump apparatus comprising:

a linear electric motor having a reciprocable drive member, first and second drive pistons mounted at opposed ends of said drive member for reciprocation therewith within respective first and second drive cylinders, first and second pump pistons reciprocably movable within first and second pump cylinders respectively, coupling means containing hydraulic fluid drivingly connecting said first and second drive pistons with said first and second pump pistons respectively, said coupling means comprises first and second intermediate pistons reciprocably movable within respective first and second intermediate cylinders, means mechanically connecting said first and second intermediate pistons with said first and second pump pistons respectively, hydraulic coupling means coupling said first and second intermediate pistons with said first and second drive pistons respectively, and means permitting selective interruption of said hydraulic coupling means.

18. The pump apparatus of claim 17 wherein said hydraulic coupling means couple opposed sides of each of said first and second intermediate pistons with each of said drive pistons.

19. The pump apparatus of claim 18 wherein said first intermediate and pump cylinders are axially aligned, and said second intermediate and pump cylinders are axially aligned, and said mechanical connecting means comprises first and second piston rods extending between said first intermediate and pump pistons and said second intermediate and pump pistons respectively.

20. A pump apparatus comprising:

a linear electric motor having a reciprocable drive member, first and second drive pistons mounted at opposed ends of said drive member for reciprocation therewith within respective first and second drive cylinders, first and second pump pistons reciprocably movable within first and second pump cylinders respectively, and coupling means containing hydraulic fluid drivingly connecting said first and second drive pistons with said first and second pump pistons respectively, and means permitting selective interruption of said hydraulic coupling means, said drive cylinders having different diameters from said pump cylinders, whereby said drive pistons reciprocate through distance different from the distance through which said pump pistons reciprocate.

21. The pump apparatus of claim 20, wherein said drive cylinders have a diameter greater than the diameter of said pump pistons.

* * * * *